US005142105A

United States Patent [19]

Kihlken et al.

[11] Patent Number: 5,142,105

[45] Date of Patent: Aug. 25, 1992

[54] ELECTRICAL CABLE AND METHOD FOR MANUFACTURING THE SAME

[75] Inventors: Dave J. T. Kihlken, Richmond, Ind.; John J. Deeter, Batavia, Ill.; Harry Nelson, Richmond, Ind.

[73] Assignee: Cooper Industries, Inc., Houston, Tex.

[21] Appl. No.: 555,165

[22] Filed: Jul. 19, 1990

Related U.S. Application Data

[62] Division of Ser. No. 446,149, Dec. 5, 1989, Pat. No. 4,973,238.

[51] Int. Cl.[5] ..... H01B 11/02; H01B 7/08; H01B 7/36

[52] U.S. Cl. ..... 174/112; 174/34; 174/36; 174/72 A; 174/117 F; 174/131 A

[58] Field of Search ..... 174/117 R, 117 F, 117 FF, 174/117 A, 72 A, 34, 36, 112, 113 C, 131 A, 109; 439/494, 495; 156/51, 52

[56] References Cited

U.S. PATENT DOCUMENTS

| | | | |
|---|---|---|---|
| 1,906,820 | 5/1933 | Shaw | 324/226 |
| 1,944,954 | 1/1934 | Sperry | 324/226 |
| 3,437,917 | 4/1969 | Gunkel et al. | 324/37 |
| 3,673,493 | 6/1972 | Hoffman et al. | 324/37 |
| 3,906,357 | 9/1975 | Runshang | 324/37 |
| 4,365,198 | 12/1982 | Toth | 324/226 |
| 4,543,448 | 9/1985 | Deurloo | 174/112 |
| 4,767,891 | 8/1988 | Biegon et al. | 174/34 |
| 4,837,405 | 6/1989 | Bonjour et al. | 174/36 |
| 4,880,484 | 11/1989 | Obermeier et al. | 174/112 X |

FOREIGN PATENT DOCUMENTS

| | | | |
|---|---|---|---|
| 1808801 | 11/1968 | Fed. Rep. of Germany . | |
| 86482 | 7/1978 | Japan | 174/112 |
| 413841 | 7/1934 | United Kingdom | 174/112 |
| 1432548 | 4/1976 | United Kingdom . | |

*Primary Examiner*—Morris H. Nimmo
*Attorney, Agent, or Firm*—Fitch, Even, Tabin & Flannery

[57] ABSTRACT

An improved cable assembly having a plurality of conductors held in flat cable sections by a carrier film and cable sections in which the conductors are not held by the carrier film and method for forming such a cable assembly. The flat sections are identified by an indicia on the outer surface of the outer jacket. The method includes the steps of marking the location of the flat cable sections with a ferromagnetic implant, extruding an outer jacket around the conductors and implant, detecting the location of the implant, and applying indicia to the outside surface of the outer jacket to identify the location of the flat cable section.

6 Claims, 3 Drawing Sheets

FERROMAGNETIC IMPLANT 22
24
26
28
30
32
34
36
64
68
3
5

ELECTRICAL CABLE AND METHOD FOR MANUFACTURING THE SAME

This is a division of application Ser. No. 446,149, filed Dec. 5, 1989, issued as U.S. Pat. No. 4,973,238, on Nov. 27, 1990. U.S. Pat. No. 4,973,238, is directed to an apparatus for marking the outer jacket of a cable assembly. The instant invention is directed to an improved cable assembly and a method of forming the cable assembly.

This invention relates to electrical wiring components and, more specifically, to an electrical cable having spaced sections which can be formed into a flat configuration for termination by a mass termination, insulation displacement connector.

BACKGROUND OF THE INVENTION

Mass termination, insulation displacement connectors have come into increasing commercial prominence because of the significant savings in time and labor they offer compared to stripping and individually terminating each conductor using a crimp terminal. These connectors have an insulative housing body holding a number of regularly spaced terminal elements having slotted plates terminating in sharpened free ends extending beyond a surface of the body. The connectors also include covers having recesses in a facing surface for receiving the free ends of the plates. After the insulated conductors are aligned with their corresponding slotted plates, relative closing of the housing body and cover results in displacement of the insulation with the conductor cores contacting the metallic plates. For further information regarding the operation and structure of such mass termination connectors, reference may be made to U.S. Pat. Nos. 4,458,967 and 3,912,354.

The most efficient form of conductors for use with such connectors is the flat cable in which conductors, running parallel and spaced to match the spacing of the terminal elements in the connector, are held by a layer of insulation. The use of a flat cable avoids running the conductors one at a time and holding them in position for termination. The flat cable can be used for either a daisy chain connection (where the connector is applied intermediate the cable ends) or an end connection. The sharpened ends of the slotted plates pierce the web material between the conductors in the flat cable as the body and cover close so slitting of the cable between conductors is not required.

While flat cables offer many advantages with respect to efficiency in termination, they present difficulties during routing. Flat cables have certain dimensions larger than comparable round cables, the flat cables do not bend as easily, they are more susceptible to damage during routing, and the continuous presence of the layer of insulation holding the discrete conductors may result in somewhat increased weight of a flat cable.

An electrical cable has been proposed including alternating flat cable and twisted pair sections with an outer jacket holding the cable so that it has a generally circular cross section to provide flexibility superior to that of a flat cable. The provision of the twisted pair sections reduce cross talk among conductors. This cable carries spaced indicia to mark the location of the flat cable sections to limit the extent that the outer jacket need be removed to prepare a flat cable section for termination. However, in the event of significant slippage between the outer jacket and the conductors, the markings could move out of alignment with the flat cable sections. For further information concerning the structure and operation of this cable, reference may be made to commonly-assigned U.S. Pat. No. 4,767,891.

U.S. Pat. No. 4,543,448 to Deurloo for ELECTRICAL CORD teaches a magnetically identifiable conductor, for use in a cord set. The cord set has insulated conductors, each having a conductive core. A conductive core 23, in addition to copper wires, has a single steel wire strand in order to identify it as a ground lead. The cable is rotated until the ground lead having the high magnetic permeability conductor therein is brought into proximity with a detector. Once it is detected, suitable connectors may be affixed to it and the manufacturer will know that connection has been made to the ground lead at both of its ends.

U.S. Pat. No. 1,906,820 to Shaw for MAGNETIC DETECTOR is directed to an apparatus for detecting small magnetic particulates in the insulating jacket of an electrical cable during manufacture. A magnetic detector is placed in proximity with the cable and controls a cable feeding mechanism. The system interrupts manufacture of the cable in the event that a steel bristle becomes entangled therein.

U.S. Pat. No. 1,944,954 for a FLAW DETECTOR FOR ELECTRICAL CONDUCTORS discloses a method of detecting flaws in an electrical cable when current is passed through it by sensing the magnetic field formed around the cable. Thus, the cable must be energized.

British Patent Specification No. 1,432,548 is directed to a method of printing indicia on a cable after which the cable is covered with a transparent sheath.

SUMMARY OF THE INVENTION

Among the various aspects and features of the present invention may be noted the provision of an improved electrical cable having flat cable sections and twisted pair sections. The cable includes markings indicating the presence of flat cable portions so that only a limited amount of the outer jacket need be removed to expose the flat cable section to be terminated. These markings are accurately applied because the precise position of a flat cable section is detected after the outer jacket is extruded about the conductor. More specifically, prior to application of the outer jacket, ferromagnetic implants are brought together with the cable which mark the location of flat cable sections. After application of the outer jacket, the presence of the implants is detected using a ferromagnetic detector which controls marking of the location of the flat cable section on the outside surface of the jacket. The cable of the present invention and the apparatus for manufacturing the cable are reliable in use, have long service life, and are relatively economical and easy to manufacture. Other aspects and features of the present invention will be, in part, apparent and, in part, will be pointed out in the following specification and accompanying drawings.

As a method of forming a cable of generally circular cross section including the flat cable sections and sections where the conductors are not held, the invention includes several steps:

a) The location of a flat cable section is marked using a ferromagnetic implant.

b) The outer jacket is extruded about the conductors and the implant.

c) The location of the implant is detected after application of the outer jacket; and d) Indicia are applied to the outside surface of the outer jacket in response to the detection of the implant to identify the location of the flat cable section.

BRIEF DESCRIPTION OF THE DRAWINGS

Corresponding reference characters indicate corresponding components throughout the several views of the drawings.

DESCRIPTION OF THE PREFERRED EMBODIMENT

This is a division of patent application Ser. No. 446,149, filed Dec. 5, 1989, now U.S. Pat. No. 4,973,238, issued Nov. 27, 1990 which is hereby incorporated by reference.

Figures 1, 2, 3, 4, 5:
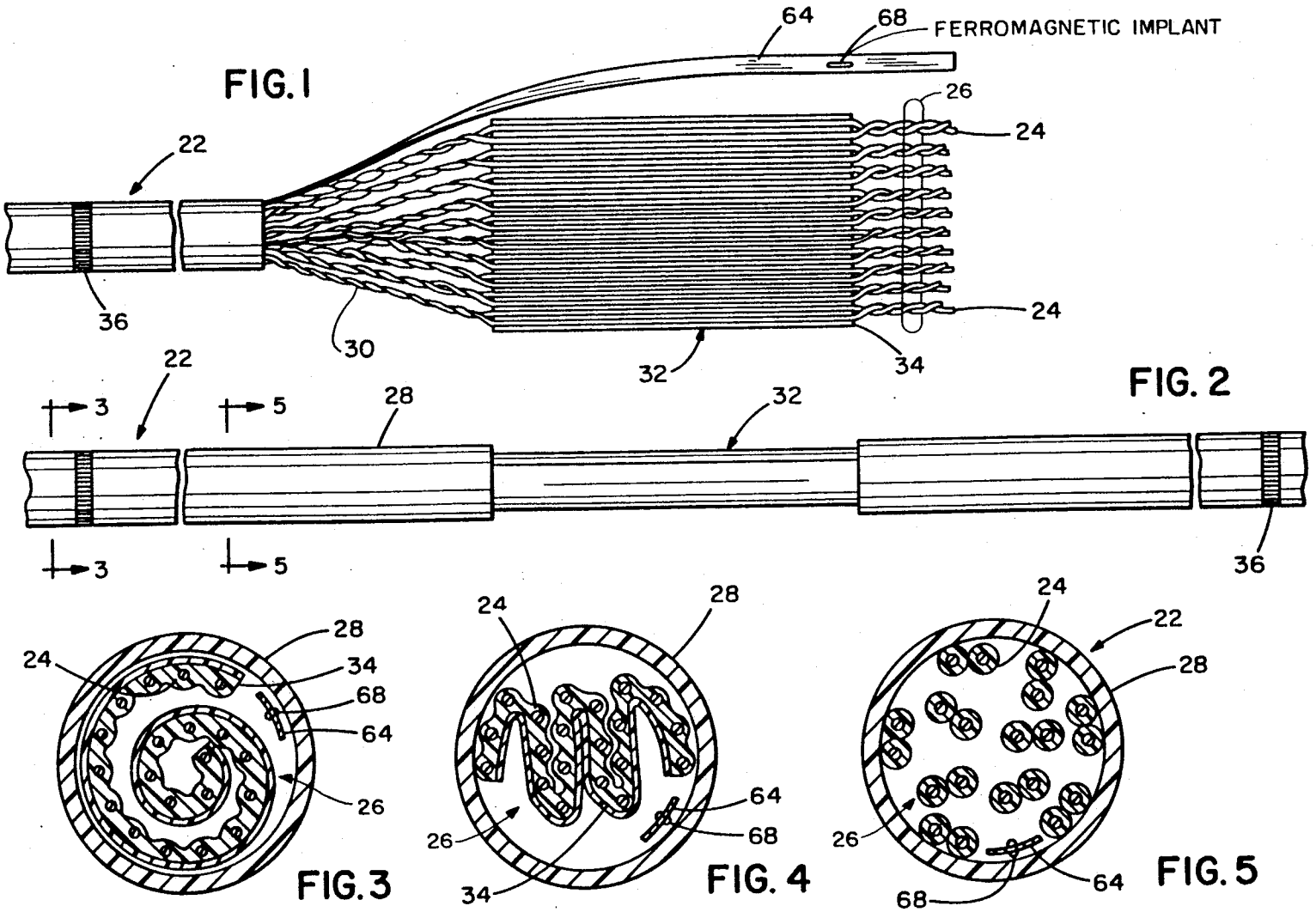
FIG. 1 is a plan view of a cable assembly embodying various features of the present invention having a cable including first or twisted pair sections and second or "flat cable" sections with the location of flat cable sections marked on the outside jacket of the cable assembly, so that a flat cable section can be located, the outer jacket removed, and the section reconfigured to a flat configuration for application of a mass termination connector.
FIG. 2 illustrates the cable assembly of FIG. 1 with a portion of the outer jacket removed and with the remainder of the cable assembly in its round configuration throughout its length.
FIG. 3 is a cross-sectional view taken generally along line 3—3 of FIG. 2 through a second cable section in which the "flat cable" is spiralled.
FIG. 4 is a cross-sectional view of an alternative embodiment of the cable of FIG. 4 wherein the flat cable section is folded instead of being spiralled.
FIG. 5 is a cross-sectional view taken generally along line 5—5 of FIG. 2 through a first cable section.
Figure 6:
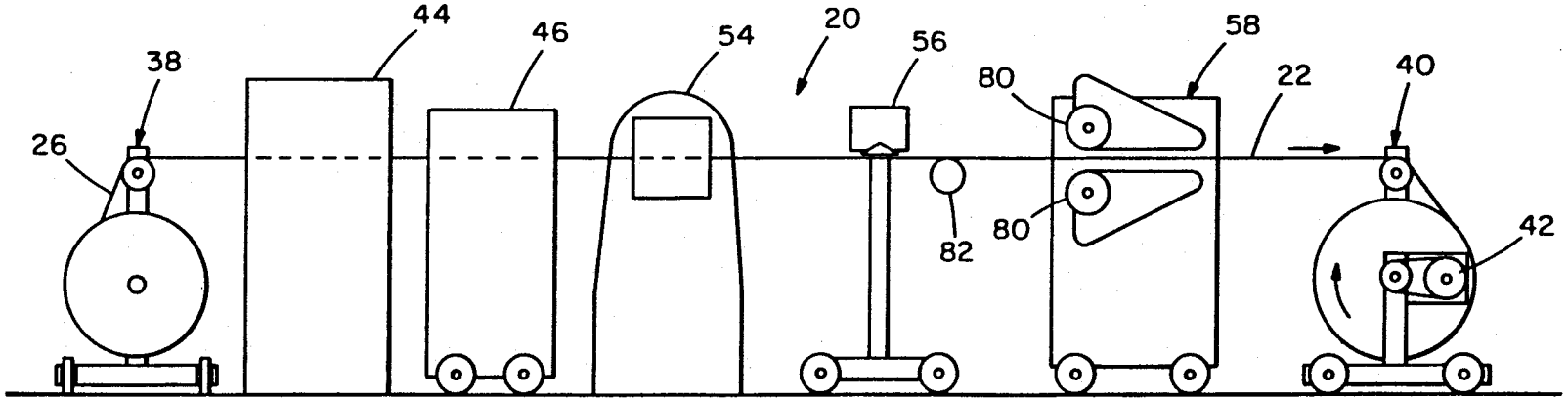
FIG. 6 is a simplified diagrammatic representation of the components of a production line for manufacturing the cable assembly of FIG. 1 including a ferromagnetic implant station, a reconfiguration station, an implant detection station, and a printing station.

Referring now to the drawings, apparatus for applying marking to the outside surface of an outer jacket of a cable assembly is generally indicated by reference numeral 20 in FIG. 6. As best shown in FIGS. 1 and 2, the cable assembly 22 includes a number of discrete electrical conductors 24 each having a conductive core and an insulating jacket surrounding the core. The cable assembly is made up of a cable 26 and an outer insulative jacket 28 holding the cable so that the cable assembly has a generally circular cross section to provide greater flexibility than a flat cable. The cable 26 includes alternating first sections 30, where the conductors 24 are arranged in twisted pairs to reduce crosstalk, and second sections 32 which can be reconfigured into flat cable portions in which the conductors are held by a carrier film 34 in a parallel, regularly spaced array so that the conductor cores match the terminals in a mass termination, insulation displacement connector. Such a carrier film and the attachment of the conductors to the film is shown and discussed in U.S. Pat. No. 4,767,891, issued Aug. 30, 1988, the teachings of which are hereby incorporated by reference.

The cable assembly 22 includes indicia 36 on the outer surface of the outer jacket 28 to mark the locations of the flat cable sections 32. Thus the installer need only strip away a limited portion of the outer jacket 28 to expose an underlying flat cable section so that it can be reconfigured in preparation for its termination.

Figure 7:
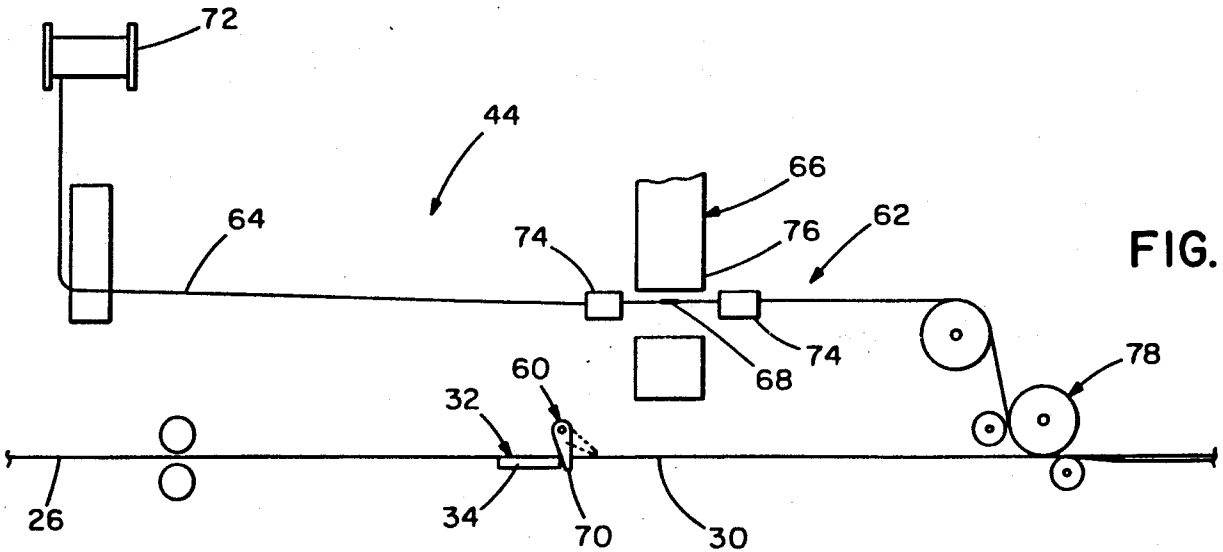
FIG. 7 is a simplified diagrammatic representation showing components of the ferromagnetic implant station.
Figure 8:
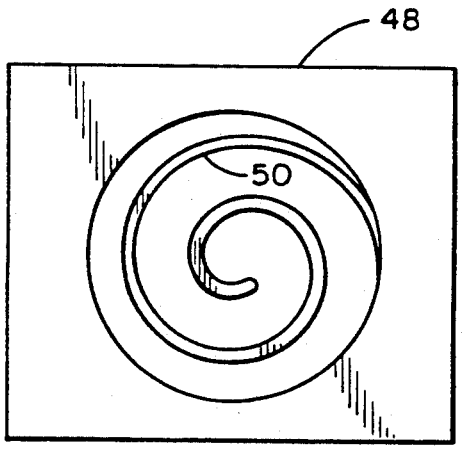
FIG. 8 shows a simplified representation of a die head at the reconfiguration station for forming the spiral cable of FIG. 3.
Figure 9:
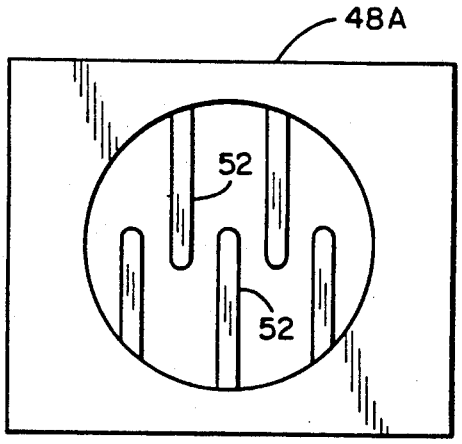
FIG. 9 shows a simplified representation of a die head at the reconfiguration station for forming the folded cable of FIG. 4.

The apparatus 20 for applying the marking 36 is shown in FIG. 6 and includes a supply station 38 for supplying a length of the cable 26 in a flat configuration, a take up station 40 positioned downstream of supply station 38 for taking up the completed cable assembly 22, and means for moving the cable toward the take up station, which could be a motor 42. The apparatus 20 also includes a station 44 for detecting a flat cable section 32 and installing an implant which can be detected after application of the outer jacket 28. The station 44 is best shown in FIG. 7. Downstream of implant station 44 is a reconfiguration station 46 in which the cable 26 is reconfigured from its flat configuration so that after application of the outer jacket 28, the cable assembly 22 has a generally circular cross section. The station 46 could include a die head 48 (FIG. 8) having a helical working surface 50 for the spiralled cable shown in FIG. 3, or the station 46 could include a die head 48A (FIG. 9) including oppositely extending, offset blades 52 for forming the folded cable of FIG. 4. Downstream of the reconfiguration station 46 is an extruder 54 for applying the outer jacket 28, followed by a detector station 56 at which the presence of an implant under the outer jacket is detected, and a printing station 58 which is responsive to the detector station 56 for applying the indicia 36. As the supply station 38, the take up station 40, the motor 42, the reconfiguration station 46, and the extruder 54 are all well know by those of skill in the art, they need not be further described here.

THE IMPLANT STATION 44

Referring to FIG. 7, the implant station 44 includes a sensor 60 positioned adjacent the pass path of the cable 26 for detecting the arrival of each flat cable section 32. Station 44 also includes a tape line 62 providing a length of tape 64 which is brought together with the cable 26 upstream of the extruder 54, and a staple application station 66 which is controlled by electrical circuitry (not shown) to apply a staple 68 formed of ferromagnetic material (also shown in FIG. 1) to the tape in response to detection of a flat cable section 32. The electrical circuitry for controlling station 44 is shown and described in detail in the aforementioned U.S. Pat. No. 4,973,238.

More specifically, the sensor 60 includes a deflectable sensor arm 70 which is pivotally mounted and is biased to a position intersecting the pass path of the cable 26 so that the arm extends between adjacent pairs of twisted conductors 24 in a first cable section 30. The arm is deflected to a second position, shown in phantom in FIG. 7, by the carrier film 34 of a flat cable section 32, and remains in that second position until the film advances beyond the sensor arm. The tape 64 is preferably of a non-extensible paper, while the tape line 62 includes a supply roll 72, guides 74 for maintaining the tape in alignment with a stapler head 76 at the staple application station, and a set of rollers 78 for causing the tape to merge with the cable 26 as both are advanced down the line.

As a method of forming a cable assembly 22, the present invention includes several steps:

a) The location of a flat cable section 32 is marked by applying a ferromagnetic implant.

b) The outer jacket 28 of the cable assembly is extruded about the conductors 24 and the implant 68.

c) The location of the implant is detected after the application of the outer jacket; and d) Indicia 36 is applied to the outside surface of the outer jacket in response to the detection to the implant to identify the location of the flat cable section 32.

In view of the above, it will be seen that the several objects of the invention are achieved and other advantageous results are attained.

As various changes could be made in the above constructions without departing from the scope of the invention, it is intended that all matter contained in the above description or shown in the accompanying drawings shall be interpreted as illustrative and not in a limiting sense.

What is claimed is:

1. A cable assembly of generally circular cross-section for use with a mass termination, insulation displacement connector having a plurality of regularly spaced terminal elements, said cable assembly comprising:

a cable including a plurality of discrete conductors extending throughout the length of said cable, each conductor having an insulative jacket made of a thermoplastic material, said cable having a plurality of spaced first sections wherein said conductors are not held by a carrier film, a plurality of second sections wherein said conductors are held by a carrier film including thermoplastic insulation, with adjacent first sections being spaced by a second section;

an insulative outer jacket about said cable;

a tape extending throughout the length of said cable inside said outer jacket; and at least one ferromagnetic implant affixed to said tape and disposed inside said outer jacket in a predetermined position relative to a said second section, the outer surface of said outer jacket bearing indicia marking the location of the last-mentioned second section whereby upon removing said jacket from that second section, that second section is deformable into a generally flat configuration with the cores of said conductors being regularly spaced to match the spacing of the terminal elements of said connector.

2. A cable as set forth in claim 1 wherein said implant is a staple.

3. A cable as set forth in claim 1 wherein said tape is formed of a substantially non-extensible paper.

4. A cable as set forth in claim 1 wherein said conductors of said first sections are arranged in twisted pairs.

5. A method of forming a cable assembly of generally circular cross section including a cable having a plurality of electrical conductors each having an insulative jacket and extending the length of said cable, said cable including a plurality of first sections in which the conductors are not held by a film of thermoplastic material, and a plurality of second sections in which the conductors are held in a film formed of a thermoplastic material with adjacent first sections being spaced by a second section, said assembly including an outer jacket of insulative thermoplastic material, and a tape extending throughout the length of said cable within said outer jacket, said method comprising the following steps:

a) marking the location of a said second section using a ferromagnetic implant affixed to said tape;

b) extruding said outer jacket about said conductors and said implant;

c) detecting the location of said implant after application of said outer jacket; and d) applying indicia to the outside surface of said outer jacket in response to the detection of said implant to identify the location of the last mentioned second section.

6. A method in accordance with claim 5 wherein said marking step comprises:

e) receiving a length of said cable;

f) receiving a length of said tape separate from said cable;

g) sensing a second section of said cable;

h) affixing a ferromagnetic implant to said tape in response to said sensing step; and i) combining said tape to run the length of said cable such that said ferromagnetic implant is placed in a predetermined position relative to said sensed second section of said cable.

* * * * *